US005272286A

United States Patent [19]

Cain et al.

[11] Patent Number: 5,272,286

[45] Date of Patent: Dec. 21, 1993

[54] SINGLE CAVITY AUTOMOBILE MUFFLER

[75] Inventors: John J. Cain, Phoenix; Dennis Barnes, Mesa; David A. Dye, Phoenix, all of Ariz.

[73] Assignee: Active Noise and Vibration Technologies, Inc., Phoenix, Ariz.

[21] Appl. No.: 879,517

[22] Filed: May 4, 1992

Related U.S. Application Data

[63] Continuation-in-part of Ser. No. 507,366, Apr. 9, 1990, abandoned.

[51] Int. Cl.[5] ..... F01N 1/06

[52] U.S. Cl. ..... 181/206; 381/71

[58] Field of Search ..... 181/206; 381/71; 60/312

[56] References Cited

U.S. PATENT DOCUMENTS

| | | | |
|---|---|---|---|
| 3,712,412 | 1/1973 | Hassett et al. | 181/206 |
| 3,936,606 | 2/1976 | Wanke | 381/71 |
| 4,044,203 | 8/1977 | Swinbanks | 381/71 |
| 4,177,874 | 12/1979 | Angelini et al. | 181/206 |
| 4,527,282 | 7/1985 | Chaplin et al. | 381/71 |
| 4,665,549 | 5/1987 | Eriksson et al. | 381/71 |

FOREIGN PATENT DOCUMENTS

| | | | |
|---|---|---|---|
| WO8907701 | 8/1989 | European Pat. Off. | 181/206 |

OTHER PUBLICATIONS

"CME Chartered Mechanical Engineer, Anti-Sound The Essex Breakthrough," Jan. 1983 by Noise Cancellation Technologies, Inc.

*Primary Examiner*—Michael L. Gellner
*Assistant Examiner*—Khanh Dang
*Attorney, Agent, or Firm*—Streich Lang

[57] ABSTRACT

A noise suppression system for use on internal combustion engines and small enough for use in automotive applications is disclosed. A cancellation noise generator and actuator speakers produce a noise to combine with and cancel the engine noise carried in exhaust gases in a mixing chamber. The resultant noise leaving the mixing chamber is measured by a circular tubular microphone array to control the noise generator.

44 Claims, 4 Drawing Sheets

SINGLE CAVITY AUTOMOBILE MUFFLER

This is a continuation of application Ser. No. 07/507,366 filed Apr. 9, 1990, now abandoned.

TECHNICAL FIELD

The present invention relates to sound muffling devices, particularly those of the type used in connection with tubes or ducts which emit sounds which one wishes to silence such as, for example, the exhaust pipes of internal combustion engines.

BACKGROUND

Very early in the evolution of the internal combustion engine, it was discovered that the relatively high levels of noise emitted during operation of the engine could be controlled, to a large extent, by resonant sound muffling devices. At least as early as about a century ago, it was discovered that a major portion of the sound emitted by an internal combustion engine exited through the tail pipe, which serves the primary purpose of exhausting spent combustion gases.

The approach toward the attenuation of these undesirably high levels of noise was to pass air exiting an engine through an acoustic filter. In principle, either high pass acoustic filters or low pass acoustic filters may be employed to muffle sounds in a duct. For example, a low pass filter is useful in order to prevent the transmission of relatively high frequency sounds. On the other hand, the low frequencies of acoustic energy which are predominant in explosive discharges, such as those created by the explosion of a gun or found in an automobile exhaust system may be filtered out using a high pass filter.

Likewise, a combination of both high pass and low pass acoustic filters may be used to achieve the elimination of noise. The elimination of noise may be viewed as generally involving the cancellation of the alternating flow of gases, representing sound transmission, while not impeding the steady flow of gas out from the exhaust system which is necessary in order to discharge spent combustion products.

As a general rule, mufflers have volumes in the range of six to eight times the piston displacement of the engine and may contain baffles with or without holes. A primary aspect of their operation involves the cancellation of sound waves by interference, usually involving breaking the waves into two parts which follow different paths and meet again out of phase before leaving the muffler. Another important aspect is that exhaust back pressure must be minimized in any muffler design, insofar as an increase of only one psi in back pressure decreases the maximum power output of an engine by about 2.5%. About 1% of this loss is due to additional work being expended by the engine to exhaust the gases. The balance of the loss is due to the effects of increased gas pressure on volumetric efficiency.

Turning to the case of ventilating ducts, a degree of noise suppression is usually obtained by lining the ducts on at least two non-opposite walls with an efficient sound-absorbing material for a distance of three to six meters from both the inlet and the outlet. Where, due to the length of available duct, this is insufficient, additional noise suppression may be provided by introducing baffles into the duct and covering the baffles with sound-absorbing materials.

In the case of duct associated noise control systems, increased speed of air flow introduces additional noise through the generation of turbulence. This must be addressed by additional baffles and/or sound absorbing materials.

Some understanding of baffle filter systems may be obtained if we consider a quarter wavelength resonant cavity. Such a cavity, known as a Helmholz cavity is a chamber closed at one end and open at the other. Because it is a quarter wavelength in length, sounds entering the open end of the chamber pass through the chamber and are reflected back to the open end of the chamber with a phase delay of one-half a wavelength. The half wavelength delay is caused because the time of transit of the acoustic disturbance through the chamber includes a forward transmission path of one-quarter wavelength and a reflected transmission back to the open end of an additional quarter wavelength.

The result is a half wavelength or 180° phase shift in the output of the cavity with respect to the sound passing over the top of the cavity. Because the signals are phase shifted with respect to each other by 180 degrees, and because, for a first approximation, we can assume that during the emission of a particular sound, the amplitude and frequency of one wavelength of the sound is substantially identical to the amplitude and frequency of the next wavelength produced by the source. Thus, a given undulation corresponding to one wavelength is exactly cancelled by the prior undulation of the sound which one wishes to cancel. Naturally, this is only true for sound having the particular frequency which results in a quarter wavelength relationship between the Helmholz cavity and the sound. However, if the frequency is not far removed from the resonant frequency of cancellation, the cancellation effect will still occur to a substantial extent.

In early automobile mufflers, the approach taken was to pass the exhaust gases over a matrix of baffles which together defined a plurality of tuned cavities. This structure acted as a filter and to a limited extent cancelled a range of sound frequencies produced by the internal combustion engine, propagated through the manifold to the tailpipe, and which would otherwise exit the engine in the form of acoustic disturbances.

Today, the quieting of such muffler systems is on the order of eight decibels.

Notwithstanding the numerous disadvantages of this sort of noise muffling system, modern mufflers remain substantially identical in their essentials. Generally, such prior art mufflers are constructed of sheet metal. More particularly, such mufflers comprise an outer shell or casing made of sheet metal and a sheet metal baffle structure secured within the casing. A path for the conduction of combustion gases and attendant acoustic disturbances is provided in the muffler adjacent the various noise absorbing cavities.

Because the exhaust gases are both hot and corrosive (being the product of the combustion of gasoline), they cause relatively quick corrosion and otherwise deteriorate the sheet metal components of the muffler. The result is that the muffler must be periodically replaced.

Still another problem with conventional mufflers is the viscous resistance which they provide to spent combustion products. Nor is the viscous resistance of the muffler of no significant effect. Rather, the resistance encountered by escaping combustion products is significant enough to adversely affect fuel efficiency and the concentration of pollutants in the exhaust gases. This is caused, in part, by the failure of the engine to exhaust spent combustion products from the cylinders with the same degree of efficiency that an internal combustion engine without a muffler achieves.

While, to some extent, the problems, involved in the rapid deterioration of automobile mufflers can be addressed through the use of relatively expensive alloys, such as certain types of stainless steel, and the use of relatively thick material, the additional cost of such high quality materials renders this uneconomical. Moreover, the additional labor costs involved in manufacturing mufflers with relatively thick sheet metal components adds cost which clearly makes such mufflers impractical.

Likewise, while it is conceivable that a muffler design including relatively wide passages for the exhaust of combustion products and numerous cavities to cancel sounds passing over them could improve the incomplete scavenging of spent gases from the cylinders, the increase in size of a device made using such an approach would make it impractical in the environment of today's automobile. Here, space is at a premium and even the present day relatively small muffler represents a significant portion of the volume of the automobile. In any event, the muffler is also often the lowest point on the automobile and thus represents the limitation on clearance over the road. In connection with this, it is noted that even in the case of diesel-engine trucks, where the problem of back pressure has required the use of relatively large mufflers and the aesthetics and size of the truck have allowed the use of large mufflers, adequate muffling of combustion noise has not been satisfactorily achieved by existing muffler systems.

SUMMARY OF THE INVENTION

The invention is intended to provide a remedy. It solves the problem of how to muffle noises in a duct, such as an engine exhaust or air-conditioning duct with a simple, durable and effective device. This configuration integrates a mixing diameter with an integral microphone for improved cancellation over a wider frequency range than previous attempts. At the same time, back pressure problems are minimized thus resulting in good fuel efficiency and minimal exhaust of pollutants into the air. The same is achieved through the use of a single or multiply chambered dynamic cavity driven by an electro-mechanical actuator which, effectively, generates an acoustic signal used to cancel noise in the duct. The inventive muffler cavity is based upon the use of a so-called ported enclosure or symmetrically loaded system. This type of enclosure is characterized by the use of a closed rear volume, together with a front volume coupled to a radiating tuned port. This novel tuned design utilizes a single circular port driven by multiple speakers which surround the exhaust pipe to provide improved cancellation. Integrated into the port design is a mixing chamber surrounded by a circular sensing microphone. With the proper components and cavity volume and port selection high efficiency cancellation can be achieved over a 50 to 300 Hz frequency range.

As compared to previous designs a single circular port is used with multiple speakers as opposed to an array of individual ports from multiple speakers arranged around the exhaust outlet. A preferred embodiment avoids locating the microphone and anti-noise port a distance away from each other for acoustic mixing in air with limited high frequency results. The inventive system brings all of the components together at the exhaust port producing a higher degree of cancellation with higher frequency response than previous designs.

In accordance with the invention, engine or other exhaust noise is introduced into a mixing region with an acoustic cancellation signal where they are caused to cancel each other. A ring-shaped microphone array is disposed around the noise source and the acoustic cancellation signal, which is produced by the actuator, to generate an error signal proportional to the degree to which cancellation has not occurred. This error signal is then used to control the signal produced by the actuator. Sensing of the sound pressure within the tubular member is done with one or more microphones where the output of the multiple microphones are combined by averaging of their individual outputs. Noise due to turbulence and other essentially random factors is cancelled through the use of a plurality of sound-sensing points.

In accordance with the preferred embodiment, a plurality of such sound-sensing points is achieved through the use of a tubular member with a plurality of sound-sensing holes disposed along its length. This tubular member is disposed concentrically with and downstream from the emission point of sound exiting the mixing region and downstream of and concentric with the acoustic output of the actuator.

This is achieved through the use of a first pipe which corresponds to the duct with noise in it being contained within a second larger pipe which is provided with the acoustic energy generated by the actuator. The use of concentric sources and a plurality of sound sensing ports in the inventive configuration results in more uniform noise cancellation, minimal mixing region size and immunity to random noise.

In another embodiment of the invention, multiple chambers are each driven by one or more mechanical actuators. The mechanical actuators associated with any one chamber generates an acoustic cancellation signal of a particular frequency range. In a preferred version of this embodiment a muffler system is constructed to have two acoustic cancellation chambers. The mechanical actuators that work into one of the acoustic cancellation chambers generates cancellation acoustics in a low frequency range; the mechanical actuators of the other chamber will generate an acoustic cancellation signal in a higher frequency range.

BRIEF DESCRIPTION OF THE DRAWINGS

One way of carrying out the invention is described in detail below with reference to drawings which illustrate only one specific embodiment of the invention and in which.

BEST MODE FOR CARRYING OUT THE INVENTION

Figure 1:
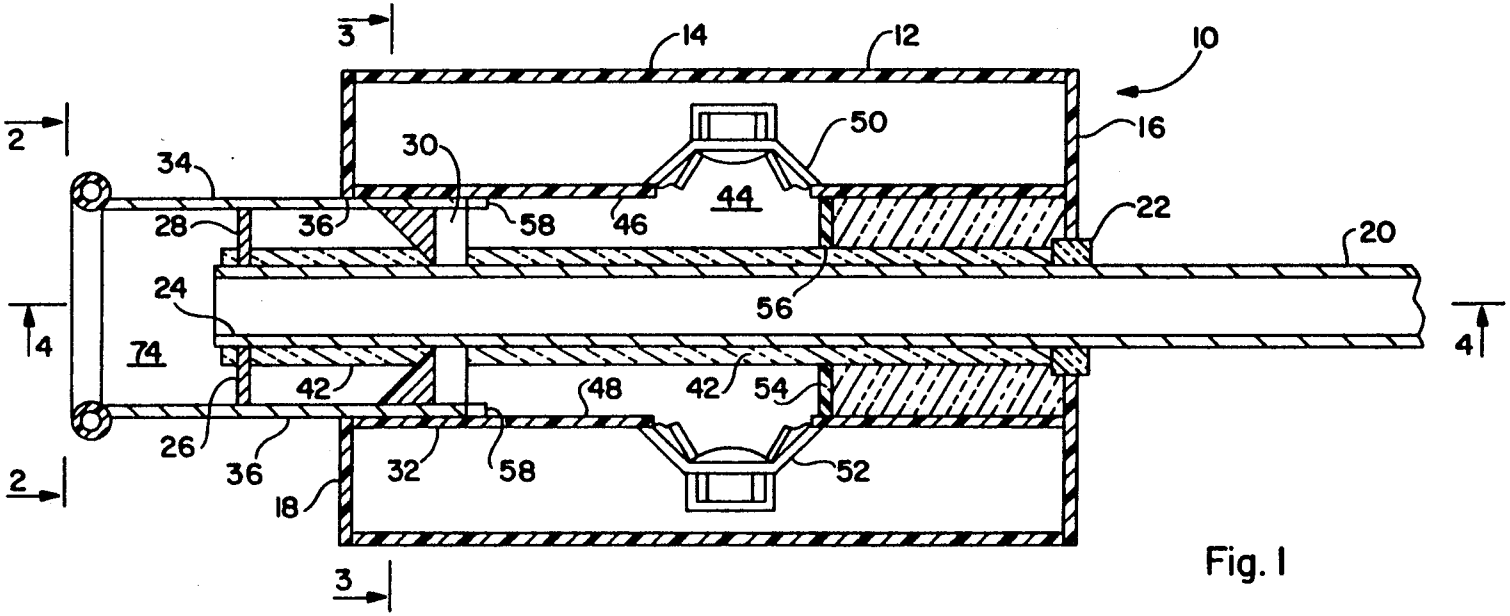
FIG. 1 is a top plan view in cross section of an engine muffler constructed in accordance with the present invention.
Figure 3:
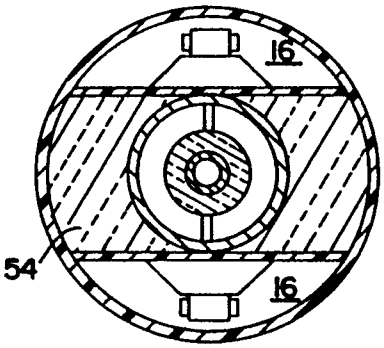
FIG. 3 is a view along lines 3—3 of FIG. 1 showing the construction of the muffler in cross section.
Figure 2:
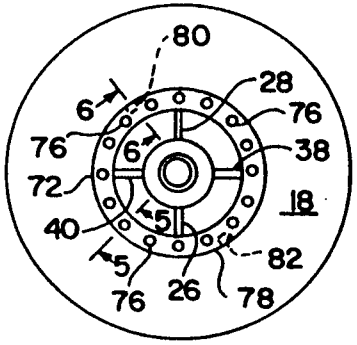
FIG. 2 is a view along lines 2—2 of FIG. 1.

Referring to FIGS. 1-3, the structure of the inventive muffler 10 is seen to comprise an outer casing 12. Outer casing 12 comprises a cylindrical member 14, a forward end cap 16 and a rear end cap 18. Cylindrical member 14, forward end cap 16 and rear end cap 18 are made of a relatively inexpensive material such as plastic which is selected for mechanical strain and durability under a wide range of temperatures and other environmental factors as would be experienced by a muffler positioned at the bottom of an automobile.

The exhaust pipe 20 is mounted within casing 12, being supported in forward end cap 16 by an insulative annular member 22.

The exhaust pipe 20 is made of steel, stainless steel or any other suitable material having a thickness sufficient to result in mechanical integrity. In addition, the exhaust pipe 20 is made thick enough to withstand the expected degree of corrosion during the life of the automobile without losing the required strength.

When installed, it is contemplated that muffler 10 will be secured to the underside of the automobile and that exhaust pipe 20 is also secured to the automobile. Insofar as it is connected to the exhaust of the engine, the end 24 of exhaust pipe 20 is held in position by a plurality of radial support members 26, 28, 30 and 32. Radial support members 26–32 are secured between exhaust pipe 20 and mixing chamber pipe 34, by being welded or otherwise suitably attached to both of these members. In accordance with the preferred embodiment, mixing chamber pipe 34 and support members 26–32 are all made of steel, or stainless steel or other suitable materials. Likewise, exhaust pipe 20, radial support members 26–32, and mixing chamber pipe 34 may be made of stainless steel in view of the resistance of this material to long exposures of high temperatures and the various combustion products created during the operation of the internal combustion engine.

Figure 4:
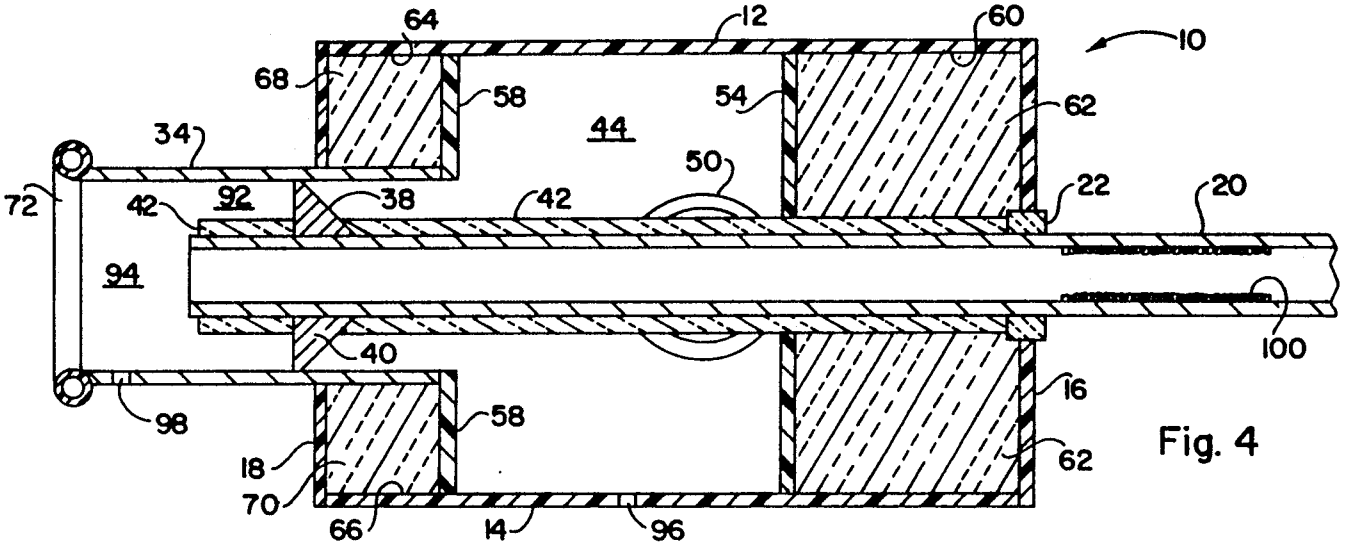
FIG. 4 is a transverse cross-sectional view of the muffler illustrated in FIG. 1 along the lines 4—4 of FIG. 1.

As illustrated in FIG. 1, mixing chamber pipe 34 (which may also be made of plastic) is securely mounted within rear end cap 18 by being securely attached or jam-fitted in a circular hole 36 within end cap 18. Finally, additional support is provided by a pair of transverse radial support members 38 and 40, as illustrated in FIG. 4. The transverse radial support members are made of material similar to that of support members 26–32. In addition, it is noted that transverse radial support members 38 and 40 and radial support members 30 and 32 are made of triangular shaped pieces of relatively thick sheet metal in order to provide support when forces are applied to the muffler structure in the direction parallel to the axis of symmetry of exhaust pipe 20.

The isolation of heat present within exhaust pipe 20 from the remainder of the system is provided by a cylindrically-shaped layer of heat insulative material 42 which is disposed around exhaust pipe 20. Typically, this is insulating fiberglass wrap, header wrap, or an isolating air cavity. An acoustical chamber 44 is defined by a pair of inner planar walls 46 and 48, actuators 50 and 52 and a forward wall 54 with a circular concentric hole 56 in its center. On the edge of the chamber opposite the forward wall 54 is a rear wall member 58. Rear wall member 58 and forward wall 54 are both made of synthetic material such as that of outer casing 12.

Referring to FIG. 4, wall 54 defines a chamber 60 which is filled with sound deadening material such as fiberglass 62 in order to change the equivalent cavity volume and improve and simplify the acoustical properties of the acoustical chamber 44. Likewise, rear wall member 58 defines a pair of chambers 64 and 66 which are filled with acoustic deadening material such as fiberglass 68 and 70 which again change the equivalent volume and simplify the operation of acoustical chamber 44 by preventing random oscillations and resonances from interfering with the operation of the muffler.

Figure 5:
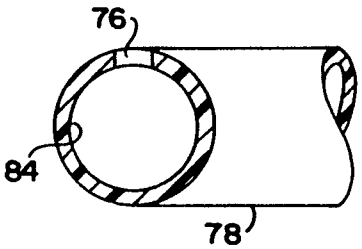
FIG. 5 is a detail along lines 5—5 of FIG. 2 illustrating the construction of a microphone assembly useful in conjunction with the muffler of FIG. 1.

Finally, a tubular microphone assembly 72 is provided at the end of mixing chamber pipe 34. A mixing chamber 74 (FIG. 1) is defined at the end of mixing chamber pipe 34. Referring to FIG. 2, a plurality of holes 76 are defined by a circular tubular member 78. Generally, holes 76 are equispaced along the circumference of member 78 and one such hole 76 is illustrated in detail in FIG. 5. Typically four microphones are also equispaced within the circumference of member 78. Actual detection of sound and conversion into an electrical signal is done by these microphones 80 and 82 which have their acoustical inputs positioned within the annular cavity 84 defined by tubular member 78. Microphone assembly 72 is secured to the end of mixing chamber pipe 34 using any suitable means such as rivets, adhesive, or the like. The electrical output of these multiple microphones are combined (averaged) using a mixing circuit to provide a composite residual error signal.

Figure 6:
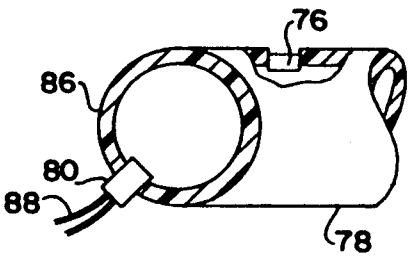
FIG. 6 is a cross-sectional view along lines 6—6 of FIG. 2 illustrating the placement of a microphone within the microphone assembly.

The placement of microphones 80 and 82 is illustrated by the enlarged detailed diagram of FIG. 6. Here microphone 80 is shown embedded in the sidewall 86 of circular tubular member 78. Microphones 80 and 82 may be positioned at a variety of angular positions depending upon whether one wishes to route the microphone cable 88 on the inside or outside of the device.

Figure 7:
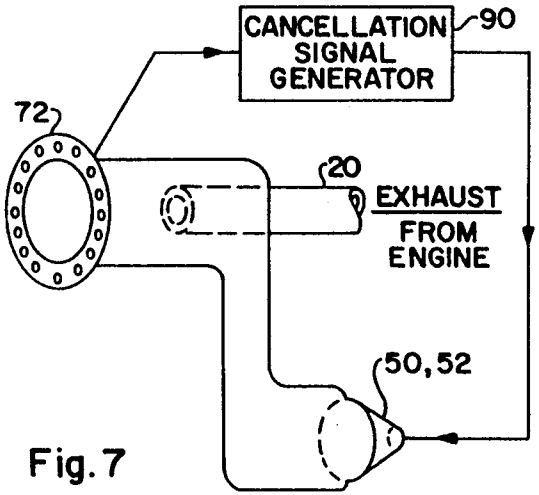
FIG. 7 is a block diagram of the inventive system.

Referring to FIG. 7, during operation of the inventive system, the noise generated by exhaust pipe 20 and actuators 50 and 52 is detected by tubular microphone assembly 72 which generates an error signal which is sent to a cancellation signal generator 90. The cancellation signal generator, in turn, generates a cancellation signal which is coupled to actuators 50 and 52. A cancellation signal generator such as that marketed by several companies today may be used.

In particular, in the embodiment illustrated in FIGS. 1–6, an acoustical chamber 44 which is substantially completely closed except for an annular output duct region 92 defined between exhaust pipe 20 and mixing chamber pipe 34, is provided. Thus, the acoustic energy generated by actuators 50 and 52 is transformed into a concentric source which is concentric with the noise output of exhaust pipe 20. These two concentric sources are mixed together in mixing region 94 where, in the ideal case, because successive undulations are substantially completely out of phase with each other and of equal magnitude, they add together and cancel each other resulting in zero noise at the output of the exhaust system adjacent microphone assembly 72. It has been found that a mixing region 94 on the order of ten centimeters in diameter and three centimeters in length is sufficient to achieve an acceptable degree of cancellation in an automobile muffler system.

In order to permit the flow of any liquid that may have accumulated in the muffler out of the muffler, a drip hole with a short, small diameter tube 96 is provided at the bottom of the muffler, as illustrated in FIG. 4. Depending upon the actual configuration of the tube microphone, it may also be desirable to put an additional drip hole 98 adjacent to the tube microphone assembly 72. From a practical standpoint, such drip holes will not affect the performance of the system in any substantial matter from an acoustic standpoint.

Conventional radio speakers ruggedized for use in an active muffler may be used as actuators. Ruggedization consists of using waterproof materials such as Kevlar, or impregnated materials, with a neoprene muffler surround. In particular, an acceptable degree of performance has been achieved using circular thirteen centimeter thirty watt speakers of the type manufactured by AUDAX under Catalog No. HIF13JVX. In addition, it has been found advantageous to ruggedize the speakers through the application of a protective coating of Kevlar.

It has been found that good cancellation results for typical automotive sound pressure levels may be achieved using 20 to 50 watts of electrical power into the speaker actuators 50, 52. In principle, while a single microphone speaker will also work, the provision of two or more speakers provides some redundancy and allows a smaller enclosure to be used and would appear to improve the symmetry of the system. Generally, cancellation is achieved in the range below 800 hertz. If it is desired to achieve complementary cancellation in the range above 800 hertz, a thin steel wool liner 100 (other liner materials are also acceptable) may be positioned within exhaust pipe 20 as illustrated in FIG. 4. Other traditional passive muffler attenuation methods can also be integrated in the dynamic muffler for high frequency attenuation.

The tubular ring microphone system disclosed above is both durable and has excellent performance characteristics. As can be seen, with reference to the figures, the microphones 80 and 82 are protected from the environment by being positioned within circular tubular member 78. Thus the microphone is protected from weather and heat effects. In addition, the use of numerous holes 76 in circular tubular member 78 results in numerous individual inputs to the microphones and has the result of acoustically averaging random noise, thus drastically reducing wind and exhaust turbulence effects. The tubular configuration with the multiple microphones produces a residual error signal which is the integrated-averaged error as measured along the perimeter of the ring. For a dynamic muffler measuring this error at the zone of cancellation produces a symmetrical cancellation zone that is optimum.

The tubular microphone assembly 72 is constructed from an insulating tubular material such as plastic tube. This creates a thermally insulating medium to protect the microphone. The tubular material is perforated at regular intervals, corresponding to 30–50 holes per wavelength at the highest frequency of interest (i.e., 0.44 meters separation between holes corresponding to 600 Hz). For best operation, the hole size needs to be small, typically around 0.062 meters. The hole size and number of holes can be varied to adjust the amount of sound pickup.

The plastic tube of the microphone assembly protects the microphones by surrounding them with a captive thermally insulating air medium. The use of open holes at the exhaust outlet provides an accurate means of sound transmission without directly exposing the microphone elements to the corrosive and hot exhaust gases.

An alternative configuration is to cover the perforations in the tubular member with thin (0.001") Kapton (TM) tape. This provides all the above noted advantages of the tubular microphone while providing a sealed configuration.

Figure 8:
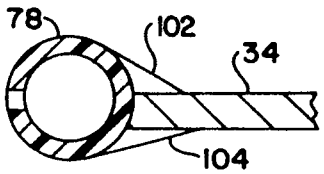
FIG. 8 is a diagrammatic view of an aerodynamic microphone design.

In connection with this, it is noted that a variety of profiles may be used in order to minimize turbulence about holes 76. For example, turbulence reducing aerodynamic surfaces 102 and 104 may be used to reduce turbulence, as illustrated in FIG. 8.

In addition, blockage of one or more of the holes in the circular microphone assembly 72 will have a less serious impact on system operation.

Figure 9:
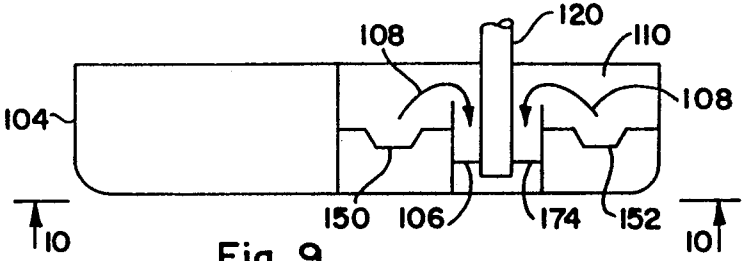
FIG. 9 is a diagrammatic representation of an alternative embodiment of the inventive muffler.
Figure 10:
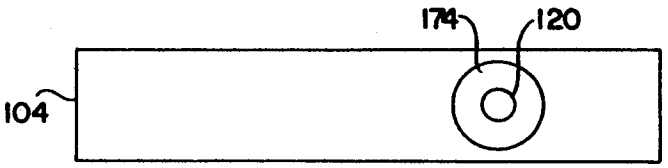
FIG. 10 is a view along lines 10—10 of FIG. 9 illustrating the outside appearance of the muffler system of FIG. 9.

An alternative embodiment is illustrated in FIGS. 9–10. Generally, similar parts or parts performing analogous or corresponding or identical functions are numbered herein with numbers which differ from those of the earlier embodiment by multiples of one hundred.

As can be seen from the alternative embodiment of FIGS. 9 and 10, it is not necessary that the muffler of the present invention take a conventional form. For example, it is possible that a bumper 104 may accommodate the inventive muffler 110. In particular, an exhaust pipe 120 may feed its output to a mixing chamber 174 which, in turn, receives the acoustic output of a pair of actuators 150 and 152. Additional advantage may be obtained by providing an annular membrane 106 to receive the output of actuators 150 and 152 and couple that output generally in the directions indicated by arrows 108 while isolating the actuators from the environment.

It has been found that the noise characteristics in the exhaust gases of internal combustion engines can vary, depending upon the structural and operating characteristics f the particular engine. Some combustion engines will produce noise harmonics predominantly in a low-frequency range, i.e., 20–200 Hz. Others may have strong harmonics in higher frequency ranges (e.g., 200 Hz–500 or 600 Hz), or both frequency ranges. For combustion engines producing noise characteristics having strong harmonics in both the low and high frequency ranges, the muffler of the present invention may need to be modified somewhat. Such modifications are illustrated in FIGS. 11–13.

Figure 11:
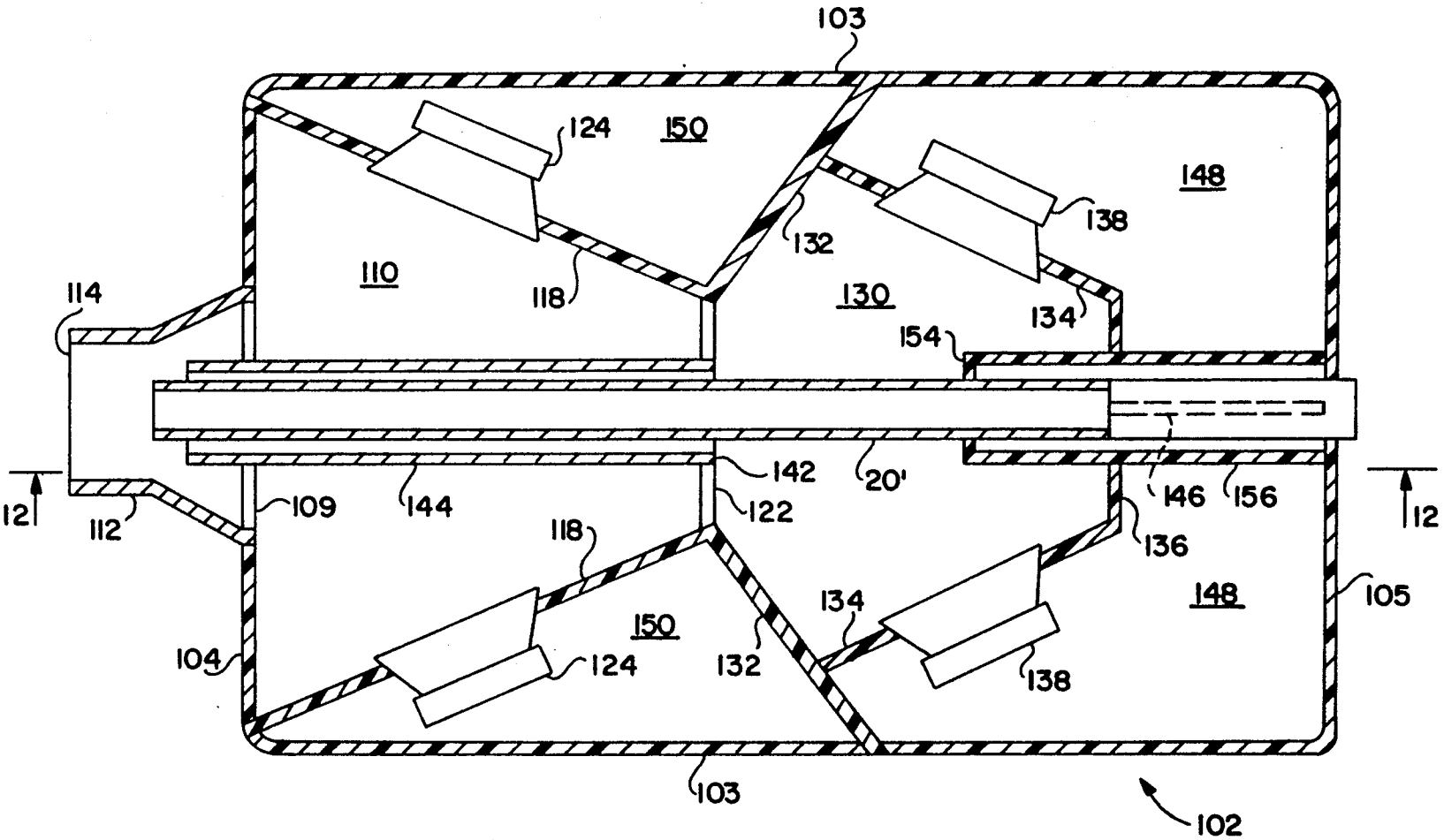
FIG. 11 is a top plan view in cross section of an engine muffler constructed in accordance with another embodiment of the present invention, illustration a muffler configuration using multiple cancellation chambers.
Figure 12:
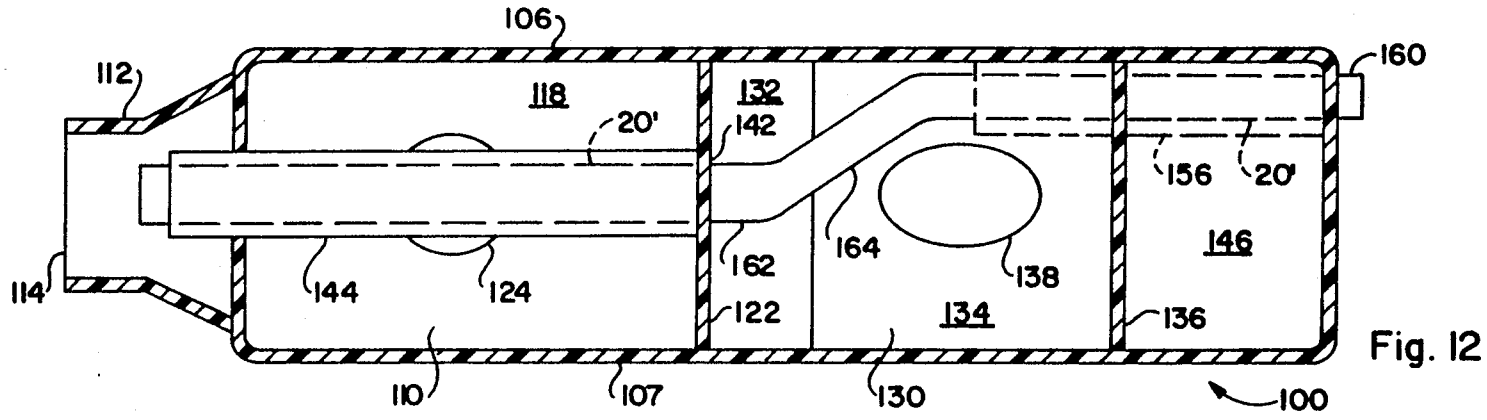
FIG. 12 is a view along lines 12—12 of FIG. 11.
Figure 13:
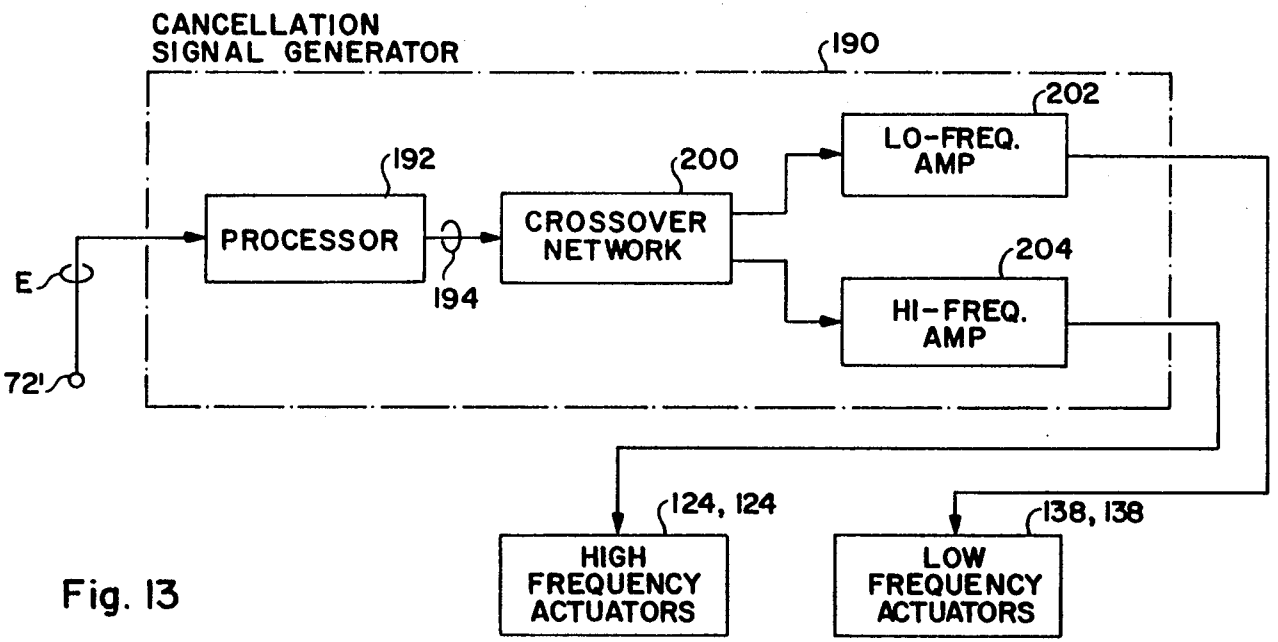
FIG. 13 is a simplified block diagram of the embodiment of the invention of FIGS. 11 and 12.

Turning to FIGS. 11 and 12, another embodiment of the present invention, one utilizing multiple cancellation chambers, is illustrated. Designated generally with the reference numeral 100, the muffler is shown as including an outer casing 102 which can be formed, as the muffler system 10, of an inexpensive material or plastic. As the FIGS. 11 and 12 illustrated, the muffler 100 is generally rectangular in shape, formed from side walls 103, 103, a rear wall 104, a front-wall 105, and top and bottom-walls 106, 107. An aperture 109 in the rear wall 104 forms the output of the muffler 100 that communicates a high-frequency acoustic cancellation chamber 110 to a mixing chamber 112. Not shown in the figures for reasons of clarity is the microphone used to develop the error signal, such as the microphone arrangement of FIG. 7.

The high-frequency acoustic cancellation chamber 110 is formed by the back, top, and bottom-walls 104, 106, 107 of the outer casing 102, together with angularly oriented sidewalls 118, and an inner cross-wall 122. The sidewalls 118 and cross-wall 122 are oriented to extend between the top and bottom walls 106, 107 of the outer casing 102, and are generally perpendicular thereto.

Mounted in each of the divider walls 118 is a high-frequency mechanical actuator 124. The mechanical actuators 124 preferably have a frequency response in the range of 200 Hz to 500–600 Hz. Polydax TX100 8 ohm, 7 inch speakers (part no. PR17 TX 100 1AK7), manufactured by Polydax Speaker Corporation of 10 Upton Drive, Wilmington, Mass. have been found acceptable.

Upstream of the high-frequency acoustic cancellation chamber 110, and separated therefrom by the cross-wall 122, is a low-frequency acoustic cancellation chamber 130 formed, in conjunction with the cross-wall 122, by divider walls 132 sidewalls 134, and cross-wall 136. Like the sidewalls 118 and cross-wall 122, the divider walls 132, sidewalls 134, and cross-wall 136 extend between the top and bottom walls 106, 107 of the enclosure and are generally perpendicular thereto.

Formed in the cross-wall 122 is an aperture 142 in which is mounted one end of an elongated port 144 that extends from the cross-wall 122 to terminate approximately at the exit aperture 109. The elongate part 144, which may be force fitted in the aperture 142, operates to communicate low frequency cancellation acoustics from the low-frequency acoustic cancellation chamber 130 to the mixing chamber 112.

In each of the sidewalls 134 is mounted a low frequency mechanical actuator 138, structured to operate predominantly in the frequency range of approximately 20 Hz to about 200 Hz. Low frequency speakers manufactured by M&M Electronics of 338 North Canal Street, South San Francisco, Calif. (Model: Godfather 6–4) have been found suitable for use as the mechanical actuators 138.

Extending from the cross-wall 136 to the front wall 105 of the outer casing 102 is a divider wall 146 which, together with the cross-wall 136, sidewalls 134, and divider walls 132 form a pair of back volumes 148 for the low frequency actuators 138. In similar fashion, the sidewalls 118 and divider walls 132 form, with the sidewalls 103 of the outer casing 102 (as well as top and bottom walls 106, 107, respectively), back volumes 150 for the high-frequency chamber 110. Preferably, the construction of the muffler is such that the back volumes 148, 150 are sealed to enclose a volume of air to form a spring-like cushion for the mechanical actuators 124, 138. Thus, the mechanical actuators 124, 138 and associated back volumes 148, 150 operate as what is commonly known as acoustic suspension speakers.

The exhaust pipe 20', which as explained above operates as a duct for evacuating exhaust gasses from an internal combustion engine, is brought into the muffler 100 through an aperture plate 154, into the low-frequency acoustic cancellation chamber 130. The operated plate 154 is-part of a generally U-shaped channel 156 formed in the top wall 106 of the outer casing just above the divider 146. As FIG. 12 illustrates, the exhaust pipe 20' is formed and configured to have a forward or upstream section 160 that is joined to a rear section 162 by a bend 164.

The forward section 160 of the exhaust pipe 20' is located exterior of the muffler 100, and is fixedly mounted in the U-shaped channel 156 by appropriate attachment apparatus such as, for example, welding. The sections 160, 162 and 164 may be wrapped in an appropriate insulative material 168 to protect the parts of the muffler 100 that are proximate the exhaust pipe 20'. In addition, the portions of the tailpipe 20' that travel through the divider walls 122 and 136 may be mounted therein by radial support members in a same manner that the radial support members 26, 28, 30 and 32 mount the exhaust pipe 20 in the muffler 10 (FIG. 1).

The muffler 100 operates in generally the same manner as that of muffler 10 (FIGS. 1–7) with the following exceptions. First, the cancellation signal generator 90 (FIG. 7) is replaced with the cancellation signal generator 190 of FIG. 13. As shown, the cancellation generator 190 includes a digital signal processor element that receives an error signal (E) developed by a sensor 72'. The digital signal processor 190 develops therefrom, and from a synchronization signal (not shown), in known fashion, a frequency cancellation signal that is coupled, via signal channel 194, to a crossover network 200. The crossover network 200 operates to divide the received cancellation signal into a high cancellation signal and a low cancellation signal. The two signals are then coupled from the crossover network 200 to drive high and low frequency amplifiers 202, 204 which, in turn, respectively drive the high and low frequency mechanical actuators 124, 124 and 138, 138.

The crossover network could be deleted by using the processor 192 to develop the a cancellation signals in the frequency ranges of interest.

It is important to pause at this point and note one of the distinguishing features of the muffler 100 over that of muffler 10. The mechanical actuators 124, 138 associated with the cancellation chambers 110, 140 do not directly face one another; to the contrary, they are mounted askance in the hope that the cancellation acoustics, produced will not cause undesirable interference waves. The angle of askance not believed important, just as long as the mechanical actuators associated with a particular cancellation chamber do not directly face one another. Alternatively, only one mechanical actuator may be used, but it is believed that only one actuator will not be able to develop sufficient acoustic power.

In operation, the exhaust pipe 20' communicates exhaust gasses containing undesirable noises to the muffler outlet aperture 109 for egress to the atmosphere via the mixing chamber 112. The cancellation acoustics created in the low frequency cancellation chamber 130 by the mechanical actuators 138 are communicated to the mixing chamber 112 by the elongate port 144—which extends into the mixing chamber 112. The cancellation signal received by the mechanical actuators 138 will produce cancellation acoustics predominantly in the 20 Hz–200 Hz range. In similar fashion, the mechanical actuators 124 receive a high-frequency cancellation signal to generate high frequency cancellation acoustics in the range of 200 Hz to approximately 500 or 600 Hz. The high frequency cancellation acoustics is also communicated to the mixing chamber 112 via the aperture 109. The error sensor 72' (FIG. 13) may be mounted at the terminus 114 of the mixing chamber 112, or elsewhere exterior of the muffler 100 to sense the noise content of the output of the mixing chamber 112, providing an error signal (E) for the cancellation signal generator 190 to correct the cancellation acoustics as necessary.

A muffler has been constructed in accordance with the teachings of the present invention, structured along the lines of muffler 100, having the dimensions as follows. The high and low frequency chambers 110, 130 are constructed to have volumes of approximately 1.5 and 3.42 liters, respectively. The back volumes 150 to the mechanical actuators 124 are each constructed to have a volume of approximately 1.75. The back volumes 148 for the mechanical actuators 138 are, in turn, constructed to have a 5 liter volume. The exhaust pipe 20' has a diameter of approximately 2 inches. The dimensions of the outer casing 102 is 19.75 inches long, 13.75 inches wide, and 7.25 inches high. The elongate port 144 is configured to be 4 inches in diameter, and 8.5 inches long, and is constructed of a non-corrosive, metallic material. The mixing chamber, also constructed of a non-corrosive metallic material, is provided with an diameter of 6 inches at the flared portion proximate the back-wall 104, and 5 inches diameter at its terminus 114; it is 6 inches long. The terminus of the exhaust pipe 20' is located approximately midway of the mixing chamber 112, while the terminus of the elongate port 144 is about 1 inch upstream thereof. All dimensions set forth here are external dimensions unless noted otherwise.

While an illustrative embodiment of the invention has been described above, it is, of course, understood that various modifications will be apparent to those of ordinary skill in the art. Such modifications are within the spirit and scope of the invention, which is limited and defined only by the appended claims.

We claim:

1. A system for reducing undesirable noise emanating from an output end of a duct through which output end a gaseous fluid discharges in a stream to a surrounding atmosphere, said system comprising:

a) audio input means for sensing noise emanating from said duct at a location external to said duct which audio input means generates an noise-related control signal;

b) a cancellation nose generator responsive to said control signal having an output external to said duct and generating a cancellation noise wave;

c) a walled mixing chamber at said output end of the duct and external to the duct into which mixing chamber the duct discharges;

d) an output port to atmosphere from said mixing chamber; and e) a cancellation chamber receiving said cancellation noise wave from the cancellation noise generator and opening into said mixing chamber to be acoustically coupled therewith;

wherein said walled mixing chamber is configured for combining the undesirable noise and the cancellation noise wave without substantially constraining said stream of gaseous fluid whereby undesirable noise emanating from the output end of the duct passes through said mixing chamber for cancellation before discharging to the atmosphere.

2. A system according to claim 1, wherein said cancellation chamber extends annularly around said outlet end whereby undesired noise radiating from said outlet end or from gaseous fluid discharging therefrom is subject to mixing with and reduction by said cancellation noise wave.

3. A system according to claim 1 wherein said audio input means comprises an annular array of microphones distributed within an audio input chamber disposed around said gaseous discharge stream and disposed downstream of said mixing chamber.

4. A system according to claim 3, wherein said walled mixing chamber comprises a mixing pipe extending around and peripherally enclosing said mixing chamber and capable of extending around the output end of said duct, said mixing pipe having an upstream end communicating with said duct at the open end thereof and having a downstream end open to atmosphere.

5. A system as in claim 4 wherein said mixing pipe is substantially concentric with said gaseous fluid discharge stream said annular array of microphones is arranged substantially concentrically with both the direction of said gaseous fluid discharge stream and the mixing pipe.

6. A system as in claim 3 which includes said duct, wherein said walled mixing chamber includes a chamber member which together with said cancellation noise generator and said duct defines a single cancellation signal chamber.

7. A system as in claim 3 wherein the duct output end is contained within the mixing chamber, said mixing chamber is downstream of said output end and said cancellation chamber opens into said mixing chamber at points upstream of the duct output end.

8. A system as in claim 7, wherein said cancellation noise generator is a first audio loudspeaker having a front surface which is acoustically coupled to said mixing chamber and a rear surface.

9. A system as in claim 8, wherein a cancellation signal volume comprises a front cancellation volume defined between said duct and said mixing chamber member and forming a front volume of a ported audio enclosure system, said cancellation signal volume further comprising a closed rear volume acoustically coupled to the rear surface of said first loudspeaker.

10. A system as in claim 9, wherein said audio input means comprises a closed tubular loop having an interior and having at least one microphone acoustically coupled to said interior and comprises a plurality of holes disposed in said tubular loop, said tubular loop being disposed substantially around said output port.

11. A system as in claim 9, further comprising a second loudspeaker positioned, configured and dimensioned to generate a signal substantially symmetrical with respect to the cancellation noise generated by said first loudspeaker.

12. A system as in claim 1, wherein a cancellation signal volume comprises a front cancellation volume defined between said duct and said mixing chamber member and forming a front volume of a ported audio enclosure system, said cancellation signal volume further comprising a closed rear volume defining member acoustically coupled to the rear surface of said cancellation noise generator.

13. A system as in claim 12, wherein said audio input means comprises a tubular loop having an interior and having at least one microphone acoustically coupled to said interior and comprises a plurality of holes disposed in said tubular loop, said tubular loop being disposed substantially around said output port.

14. A system as in claim 13, further comprising a second cancellation noise generator positioned, configured and dimensioned to generate a signal at a point substantially symmetrical with respect to the cancellation noise generated by said cancellation noise generator.

15. A system as in claim 12, further comprising a second loudspeaker positioned, configured and dimensioned to generate a signal substantially symmetrical with respect to the cancellation noise generated by said first loudspeaker.

16. A system for preventing undesirable noise from emanating from an output end of an inner ducting arrangement, said system comprising said inner ducting arrangement, a plurality of audio inputs disposed around said output end of said inner ducting arrangement for sensing noise at said output end and generating a control signal, a cancellation noise generator responsive to said control signal and including a cancellation chamber having an output acoustically coupled to a walled mixing volume defined within an outer ducting arrangement, said generator generating a cancellation noise, and said audio inputs being positioned outside said mixing volume, said mixing volume being configured for combining the undesirable noise and the cancellation noise to cancel a substantial portion of the undesirable noise.

17. A system as in claim 16, wherein said plurality of audio inputs comprises a tubular member having an interior, at least one microphone acoustically coupled to said interior and a plurality of holes disposed in said tubular member, said tubular member being disposed substantially around said output end.

18. A system as in claim 17, wherein said tubular member is closed and said cancellation noise generator is a loudspeaker, having front and rear surfaces and a volume defined by said outer ducting arrangement forms a front volume of a ported audio enclosure system and further comprising a closed rear volume defining member acoustically coupled to the rear surface of said loudspeaker.

19. A system as in claim 17, further comprising a second loudspeaker positioned, configured and dimensioned to reinforce the cancellation noise generated by said first loudspeaker.

20. A system for preventing undesirable noise from emanating from an output end of a device, said system comprising the device, a plurality of audio inputs for sensing noise at said output end and generating a control signal, a cancellation noise generator for generating a cancellation noise in response to said control signal and having an output acoustically coupled to a mixing volume acoustically coupled to receive said undesirable noise, said mixing volume being configured for combining the undesirable noise and the cancellation noise to cancel a substantial portion of the undesirable noise, said plurality of audio inputs comprising a tubular member having an interior and having at least one microphone acoustically coupled to said interior and a plurality of holes disposed in said tubular member.

21. A system as in claim 20, wherein said tubular member is disposed substantially around said output end.

22. An automotive noise suppressor for reducing noise emitted from an internal combustion engine, comprising:

(a) an exhaust duct coupled to said internal combustion engine, defining an inside passage for exhausting hot gases and having an output end;

(b) an outer casing having an output port, said outer casing surrounding said exhaust duct and extending in length beyond said output end of said exhaust duct to define a protected space between said exhaust duct and a portion of the inside surface of said outer casing and a mixing space acoustically coupled to said protected space and adjacent said output end of said exhaust duct;

(c) heat insulative material secured to the portion of said exhaust duct adjacent said protected space;

(d) an audio transducer positioned adjacent and acoustically coupled to said protected space and remote from said mixing space;

(e) a cancellation signal generator having an output coupled to said audio transducer; and (f) a microphone positioned at a point downstream of said mixing space for generating an audio feedback signal, said audio feedback signal being coupled to said cancellation signal generator to cause said cancellation signal generator to drive said audio transducer to generate an audio signal which will cancel a substantial portion of said noise emitted from said internal combustion engine.

23. A noise suppressor as in claim 22, wherein said audio transducer has a front surface and a rear surface, said protected space forming a front volume of a ported audio enclosure system, said front surface being acoustically coupled to said front volume and further comprising a closed rear volume acoustically coupled to the rear surface of said audio transducer.

24. A noise suppressor as in claim 23, comprising a tubular loop having an interior, at least one microphone acoustically coupled to said interior and having a plurality of holes disposed in said tubular loop.

25. A noise suppressor as in claim 22, comprising a tubular loop having an interior, at least one microphone acoustically coupled to said interior and having a plurality of holes disposed in said tubular loop.

26. A noise suppressor as in claim 25, wherein said holes are disposed around said output port of said outer casing.

27. A noise suppressor as in claim 25, wherein said tubular loop is disposed substantially around said output port.

28. A noise suppressor as in claim 25, further comprising a second audio transducer positioned, configured and dimensioned to generate a signal substantially symmetrical with respect to an audio signal generated by the first said audio transducer.

29. A noise suppressor as in claim 27, wherein audio transducer is a loudspeaker comprising a cone, a resilient member for supporting said cone and an electromechanical transducer-driver.

30. An automobile noise suppressor for reducing noise emitted from an internal combustion engine, comprising:

(a) an exhaust duct coupled to said internal combustion engine, said exhaust duct defining an inside passage for exhausting hot gases and having an output end;

(b) an outer casing having an output port, said outer casing symmetrically surrounding said exhaust duct and extending beyond said output end of said exhaust duct to define a protected space between said exhaust duct and a portion of an inside surface of said outer casing and a mixing space acoustically coupled to said protected space and adjacent said output end of said exhaust duct;

(c) wall structure disposed between said protected space and said exhaust duct, said wall structure being in facing spaced relationship to said exhaust duct and positioned, configured and dimensioned to define an acoustic passage between said protected space and said mixing space;

(d) a plurality of audio transducers positioned adjacent and acoustically coupled to said protected space;

(e) a cancellation signal generator having an output coupled to said audio transducers; and (f) a microphone positioned at a point downstream of said mixing space for generating an audio feedback signal, said audio feedback signal being coupled to said cancellation signal generator to cause said cancellation signal generator to drive each said audio transducers to generate an audio signal which will cancel a substantial portion of said noise emitted from said internal combustion engine.

31. A noise suppressor as in claim 30, wherein said audio transducer comprises a pair of loudspeakers each having a front surface and a rear surface, said protected volume forming front volumes of a pair of respective ported audio enclosures, said front surfaces being acoustically coupled to respective ones of said front volumes and further comprising a pair of closed rear volumes acoustically coupled to a respective one of said rear surfaces of said loudspeakers.

32. A noise suppressor as in claim 31, comprising a tubular loop having an interior, at least one microphone acoustically coupled to said interior and having a plurality of holes disposed in said tubular loop.

33. A system for reducing undesirable noise emanating from an output end of a duct though which output end a gaseous fluid discharges in a stream to a surrounding atmosphere generally in a direction away from said duct, said system comprising:

a) audio input means for sensing noise emanating from said duct at a location external to said duct which audio input means generates a noise-related control signal;

b) a cancellation noise generator responsive to said control signal and which generates a cancellation noise wave; and c) means acoustically to couple said cancellation noise wave with said undesirable noise thereby to reduce said noise;

wherein said audio input means comprises:

d) an arcuate audio input chamber; and e) a plurality of audio input devices distributed within said audio input chamber;

and wherein said audio input chamber is disposed around said stream of gaseous fluid to receive sound therefrom, has a protective wall between the gaseous flow and the audio input devices, and has means to admit sound from the gaseous fluid flow to the audio input chamber whereby said audio input chamber can serve to smooth said noise emanating from said duct for input to the input device.

34. A system according to claim 33 wherein said audio input chamber is annular and said audio input devices are disposed symmetrically therearound.

35. A noise suppressor for reducing noise emitted from an output of a device, comprising:

a duct configured and dimensioned to be coupled at an input end to the output of said device, said duct defining an inside passage and having an output end;

an outer casing having an output port surrounding said duct and extending in length beyond said output end of said duct to define a first space between said duct and a portion of the inside surface of said outer casing and a mixing space acoustically coupled to said first space and adjacent said output end of said duct;

a plurality of audio transducers positioned adjacent and acoustically coupled to said first space and remote from said mixing space each of said plurality of audio transducers being oriented to generate an audio signal in a direction angular to that of said other audio transducers;

a cancellation signal generator having an output coupled to said audio transducers; and a microphone positioned at a point downstream of said mixing spaced for generating an audio feedback signal, said audio feedback signal being coupled to said cancellation signal generator to cause said cancellation signal generator to drive said audio transducers to generate said audio signals which will cancel a substantial portion of said noise emitted from said device, said first mixing spaces being substantially open to an environment around said device.

36. An automobile noise suppressor for reducing noise emitted from an output end of an exhaust duct that is connected to an internal combustion engine to communicate exhaust gases therefrom, the noise suppressor comprising:

an outer casing having an output port, said outer casing surrounding said exhaust duct with said output port adjacent said output end of said exhaust duct, and including a wall structure defining a first and second compartment between said exhaust duct and a portion of an inside surface of said outer casing and an acoustic passage communicating each said compartment to said output port of said of said outer casing;

a first audio transducer positioned adjacent and acoustically coupled to at least a first one of said first compartment;

a second audio transducer positioned adjacent and acoustically coupled to at least a second one of said second compartment;

a cancellation signal generator having at least first and second outputs respectively coupled to said first and second audio transducers; and a microphone positioned at a point downstream of said output port for generating an audio feedback signal, said audio feedback signal being coupled to said cancellation signal generator to cause said cancellation signal generator to drive said first of audio transducer to generate a first audio signal and to drive said second audio transducer to generate a second audio signal, different from said first audio signal.

37. The noise suppressor of claim 36, wherein the acoustic passage includes means separately communicating said first and second audio signals to the output port to cause cancellation of a portion of said noise emitted from said internal combustion engine.

38. The noise suppressor of claim 36, wherein the first audio signal contains audio frequencies predominantly in a frequency range higher than the audio frequencies predominantly contained in the second audio signal.

39. The noise suppressor of claim 38, wherein the first audio transducer has a frequency response substantially in the range of 200 Hz–600 Hz.

40. The noise suppressor of claim 38, wherein the second audio transducer has a frequency response substantially in the range of 20 Hz–200 Hz.

41. The noise suppressor of claim 36, said wall structure including means separating the first chamber from the second chamber.

42. The noise suppressor of claim 41, wherein said acoustic passage includes means for communicating the first chamber, to the output port of the outer casing separately from the second chamber.

43. The noise suppressor of claim 36, the outer casing including a mixing volume being configured for receiving and combining the exhaust gases from the duct and said first and second audio signals to cancel a substantial portion of the noise.

44. The noise suppressor of claim 36, including a tubular member having an interior, said microphone being acoustically coupled to said interior and a plurality of holes disposed in said tubular member, said tubular member being positioned downstream of said output port of said outer casing.

* * * * *